US012612726B2

(12) United States Patent
Rawat

(10) Patent No.: US 12,612,726 B2
(45) Date of Patent: Apr. 28, 2026

(54) DRYER VENT MONITORING AND LINT CLEANING SYSTEM

(71) Applicant: Ritika Rawat, Edison, NJ (US)

(72) Inventor: Ritika Rawat, Edison, NJ (US)

( * ) Notice: Subject to any disclaimer, the term of this patent is extended or adjusted under 35 U.S.C. 154(b) by 59 days.

(21) Appl. No.: 18/745,935

(22) Filed: Jun. 17, 2024

(65) Prior Publication Data

US 2025/0382737 A1 Dec. 18, 2025

(51) Int. Cl.

| | |
|---|---|
| ***D06F 58/22*** | (2006.01) |
| ***D06F 101/20*** | (2020.01) |
| ***D06F 103/28*** | (2020.01) |
| ***D06F 105/34*** | (2020.01) |
| ***D06F 105/58*** | (2020.01) |

(52) U.S. Cl.

CPC ..... *D06F 58/22* (2013.01); *D06F 2101/20* (2020.02); *D06F 2103/28* (2020.02); *D06F 2105/34* (2020.02); *D06F 2105/58* (2020.02)

(58) Field of Classification Search

CPC .. D06F 58/22; D06F 2101/20; D06F 2103/28; D06F 2105/34; D06F 2105/58

See application file for complete search history.

(56) References Cited

U.S. PATENT DOCUMENTS

| | | | | |
|---|---|---|---|---|
| 10,590,593 | B1 * | 3/2020 | Leibman | A47L 7/009 |
| 2006/0096116 | A1 | 5/2006 | Martinez | |
| 2015/0247278 | A1 | 9/2015 | Gregory et al. | |
| 2018/0245276 | A1 | 8/2018 | Borden | |

FOREIGN PATENT DOCUMENTS

| | | | | |
|---|---|---|---|---|
| CN | 205270277 U | * | 6/2016 | |
| CN | 108950988 A | * | 12/2018 | |
| CN | 113930940 A | * | 1/2022 | D06F 33/57 |
| KR | 101480265 B1 | * | 1/2015 | |
| WO | WO-2017018782 A1 | * | 2/2017 | H04L 12/12 |
| WO | WO-2018015214 A1 | * | 1/2018 | D06F 33/54 |
| WO | WO-2019121302 A1 | * | 6/2019 | A47L 15/0021 |

OTHER PUBLICATIONS

Translation, WO-2019121302-A1 (Year: 2019).*
Translation, WO-2018015214-A1 (Year: 2018).*
Translation, WO-2017018782-A1 (Year: 2017).*
Translation, CN-205270277-U (Year: 2016).*
Translation, KR-101480265-B1 (Year: 2015).*
Translation, CN-113930940-A (Year: 2022).*
Translation, CN-108950988-A (Year: 2018).*

* cited by examiner

*Primary Examiner* — Jessica Yuen

(57) ABSTRACT

A device for dryer vent includes a sensor node having a plurality of sensors, a base node that receives data transmission package from sensor node, a robotic device placed inside a robotic device housing. Base node on blockage detection communicates with the robotic device which is capable of autonomous traversal inside dryer vent to clean the dryer vent. A lint basket placed inside the robotic device housing is used by the robotic device to store lint removed from dryer vent during a cleaning cycle. A latch placed inside robotic device housing communicates with base node to allow the robotic device to enter or exit the robotic device housing during the cleaning cycle.

6 Claims, 2 Drawing Sheets

DRYER VENT MONITORING AND LINT CLEANING SYSTEM

CROSS-REFERENCE TO RELATED APPLICATIONS

U.S. PATENT DOCUMENTS

| | | | |
|---|---|---|---|
| US 20060096116 A1 | May 2006 | Martinez; Ruben E | D06F 58/22 |
| US 20150247278 A1 | September 2015 | Gregory; David Geroge et al. | D06F 58/22 |
| US 20180245276 A1 | August 2018 | Borden; Garrett P. | D06F 58/20 |

BACKGROUND OF THE INVENTION

The present invention relates to a device for autonomous blockage detection and removing the lint blocking the dryer vent. The present invention also aims to detect and alert the presence of hazardous air pollutants including carcinogens emitted from the dryer vent, correlating the pollutants emitted to the detergent used for washing clothes. This will allow homeowners to choose a more eco-friendly and chemical-safe detergent.

According to Residential Energy Consumption Survey (RECS) data for 2020, ~19 million American homes have a clothes dryer running using natural gas. Clothes dryer usage can vary from 0 to 15 loads per week across the spectrum. The build-up of lint in the dryer vent can increase the time it takes to dry clothes effectively, leading to higher consumption of fossil fuels. A clogged dryer vent that goes unnoticed can become a fire hazard. About ~15,970 homes annually have a fire incident. 92% of these are due to clogged dryer vent. These fires caused annual averages of 13 deaths, 444 injuries, and $238 million in direct property damage. A blocked dryer vent also results in less ventilation leading to harmful greenhouse gasses leaking back into the home. Similar challenges exist in Laundromats. The most basic task for a homeowner is to frequently clean the clothes dryer lint filter and perform cleaning of the dryer vent annually. While the former is usually taken care of due to the accessibility of the clothes dryer lint filter, homeowners do not clean the dryer vent annually. The lack of cleaning of the dryer vent is attributed to the lack of simple tools for homeowners to accomplish this task themselves and the subsequent need to hire someone to clean the dryer vent.

Additionally, hazardous chemicals are coming out of dryer vent that have been long overlooked. Fragranced laundry products emit a range of hazardous air pollutants. Exposure to fragranced emissions from laundry products has been associated with adverse health effects such as asthma attacks and migraine headaches. The U.S. Environmental Protection Agency (EPA) has now classified seven dryer vent emissions as hazardous air pollutants and two as known human carcinogens. Known laundry detergent brands continue to use toxic chemicals that adhere to clothes after the wash cycles, leach into the air from the clothes dryer, and directly expose the homeowners to harmful effects unknown to the homeowner.

Over time, the solutions developed are limited to adding a secondary lint trap filter in the dryer vent to trap the lint that escaped the clothes dryer into the dryer vent or using an air blower to blow the lint out of the dryer vent after it has accumulated. Neither of these solutions has been widely adopted.

Multiple solutions exist that try to detect blockage by different means and provide an alarm. However, none of these solutions are fully integrated into an autonomous self-reliant system where detecting a blockage in the dryer vent triggers a robotic device to autonomously clean the dryer vent without human intervention. This invention aims to solve this problem.

Additionally, currently, no solution exists for a homeowner to monitor hazardous air pollutants including carcinogens being emitted into the air from the dryer vent due to their choice of laundry detergent product used in clothes dryer. This invention aims to provide homeowners with such a solution.

SUMMARY OF THE INVENTION

The first objective of the present invention is to provide a device for dryer vent blockage detection that autonomously triggers a robotic device that can move bi-directionally to remove the lint blocking the dryer vent. The second objective of the present invention aims to detect and alert the presence of hazardous air pollutants including carcinogens emitted from the dryer vent correlating the pollutants emitted to the detergent used for washing clothes in the clothes dryer.

In such an embodiment, the present invention consists of a sensor node placed inside a sensor node housing at the exit of the dryer vent having a plurality of sensors. The plurality of sensors is exposed to the inside of the dryer vent. The sensor node uses a long-range radio module to send data transmission packages to a base node.

A robotic device resides inside a robotic device housing at the exit of the dryer vent. The robotic device housing has a lint basket which is used by the robotic device to store collected lint during the cleaning cycle The robotic device housing has a latch to allow the robotic device to traverse in and out of the robotic device housing. The base node is placed inside the building and receives real-time data transmission packages from the sensor node. The base node on the determination of blockage, using the data packages received from the sensor node, sends a real-time message to open the latch of the robotic device housing. The base node also sends a message to the robotic device activating the robotic device.

On receiving a message from the base node, the robotic device traverses out of the robotic device housing and enters the dryer vent. The robotic device is made to operate in the dryer vent of 3¾ inch diameter or more. The base chassis of the robotic device has four mounted wheels with two servo motors attached to the individual two rear wheels. The front of the robotic device has a robotic arm with a predictable parallel motion to open and close the robotic arm. The front of the robotic device is also mounted with an ultrasonic sensor, a camera, a buzzer, and a light. A microcontroller for robotic devices and a power supply are mounted on the base chassis. An app can be used to manage the configuration settings of the robotic device and view streaming video on a smartphone.

The robotic arm is lightweight and has a maximum opening range reasonable enough to grasp any object in the dryer vent. The ultrasonic sensor enables the robotic device to detect the presence of lint. The ultrasonic sensor has two ultrasonic transducers. One is a transmitter that outputs ultrasonic pulses; the other is a receiver that listens for reflected waves. When the ultrasonic sensor is within a configured distance of lint the robotic device will stop, generate a buzzing sound, open the robotic arm, and grab the lint by closing the robotic arm. Once the lint is grabbed the robotic device will reverse out of the dryer vent back into the robotic device housing to drop the lint into the lint basket by opening the robotic arm. The cycle repeats till the dryer vent is completely cleaned. At the end of the cycle, the robotic device returns to the robotic device housing and sends a message to the base node that the cleaning is complete. The base node then sends a message to close the latch of the robotic device housing. When the lint basket becomes full a message is sent to the base node to alert the homeowner to clean the lint basket.

The present invention also aims to detect and alert the presence of hazardous air pollutants including carcinogens emitted from the dryer vent correlating the pollutants emitted to the detergent used for washing clothes. In such an embodiment, the present invention consists of a sensor node placed inside a sensor node housing at the exit of the dryer vent with a plurality of sensors to detect acetaldehyde, benzene, ethylbenzene, methanol, m/p-xylene, o-xylene, toluene, acetone, α-pinene, D-limonene and linalool. The sensor node uses a long-range radio module to send data transmission packages to the base node. A means for homeowners to input the laundry detergent used in the clothes wash cycle before switching on the clothes dryer is also provided. This inputted data is sent to the base node. The sensor node tracks real-time data on the emission of hazardous air pollutants including carcinogens detected in the dryer vent from the clothes washed with this detergent and sends this data to the base node. The base node correlates these hazardous air pollutants including carcinogens with the laundry detergent provided by the homeowner. Real-time data is available on the app through the base node. When the base node detects hazardous air pollutants including carcinogens above the acceptable limit a real-time alert is provided to the homeowner.

The present invention aims to provide homeowners with an autonomous alerting and dryer vent cleaning device that can be used to clean dryer vents as real-time blockage is detected. This will enable efficient drying of clothes, less usage of fossil fuels as clothes dryers will run more efficiently, and reduce the fire hazard from the lint clogged dryer vent. The invention also provides homeowners with real-time data on hazardous emissions from the dryer vent related to the laundry detergent used for washing. This educates homeowners about the choices of products they are making and allows homeowners to buy more eco-friendly products.

DETAILED DESCRIPTION OF THE INVENTION

Figure 1:
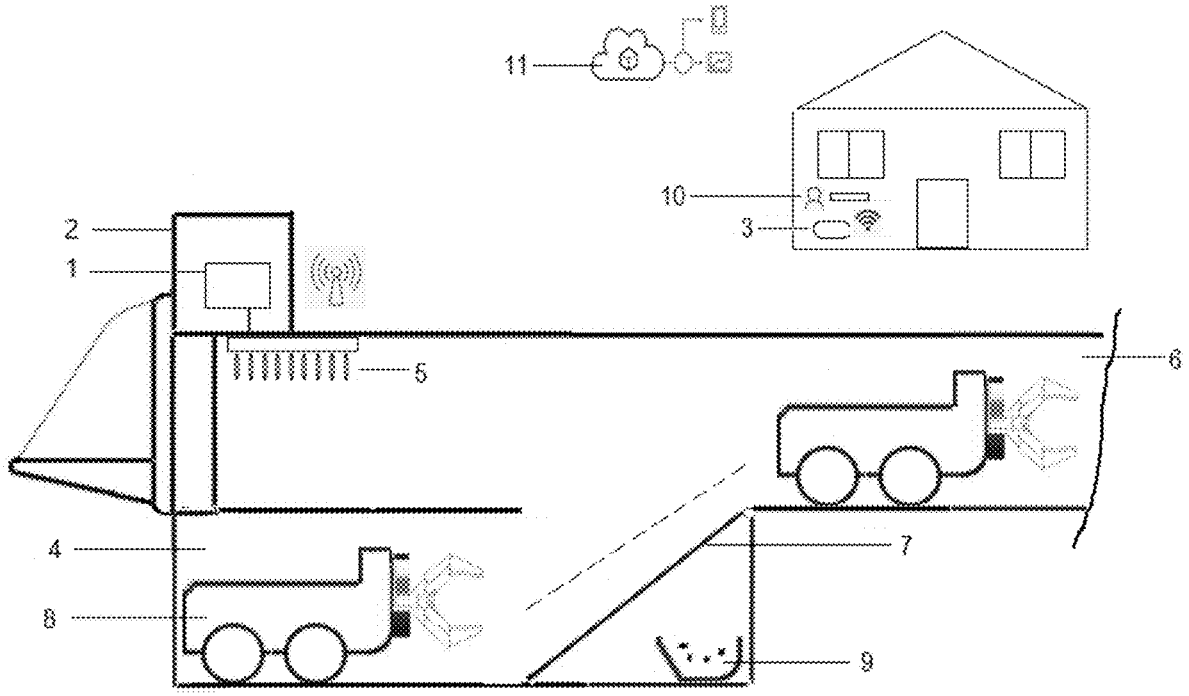
FIG. 1 is a perspective view as an embodiment of the invention showing the sensor node having a plurality of sensors and a radio module to send data to the base node. The base node triggers the robotic device to clean the dryer vent. A means for the homeowner to input the laundry detergent used for washing in the clothes wash cycle and a plurality of sensors detecting hazardous chemicals in the laundry detergent.

The invention shown in FIG. 1 consists of a sensor node 1 placed inside a sensor node housing 2 at the exit of the dryer vent 6. The sensor node 1 has a plurality of sensors 5 exposed to the inside of the dryer vent 6. The sensor node 1 sends real-time data transmission packages to a base node 3 using radio waves. The base node 3 is placed inside the building and receives real-time data transmission packages from the sensor node 1. A robotic device 8 is placed inside a robotic device housing 4 at the exit of the dryer vent 6. The robotic device housing 4 consists of a lint basket 9 used by the robotic device 8 to store collected lint during the cleaning cycle. The robotic device housing 4 has a latch 7 to allow the robotic device 8 to traverse in and out of the robotic device housing 4. The base node 3 on determining a blockage, using the data transmission packages received from the sensor node 1, sends a real-time message to open the latch 7 of the robotic device housing 4 and activates the robotic device 8. The robotic device 8 is capable of autonomous bi-directional traversal inside a 3¾ inch or more diameter dryer vent 6 to remove lint and clean the dryer vent 6. The real-time message from the base node 3 activates the robotic device 8 which traverses out of the robotic device housing 4 into the dryer vent 6. The robotic device 8 detects and removes the lint, and traverses back to put the collected lint in the lint basket 9. The cycle is repeated till the dryer vent 6 is clean and no more lint is detected by the robotic device 8. At the end of the cleaning cycle the robotic device 8 returns to the robotic device housing 4 and sends a message to base node 3 that cleaning is complete. The base node 3 then sends a message to close the latch 7. When the lint basket 9 is full a message is sent to the base node 3 to alert the homeowner to clean the lint basket 9.

As seen in FIG. 1, the invention additionally provides homeowners with a means to input the laundry detergent 10 used in the clothes wash cycle before starting the clothes dryer cycle. This inputted data is sent to the base node 3. The sensor node 1 placed inside the sensor node housing 2 at the exit of the dryer vent 6 has a plurality of sensors 5 to detect hazardous air pollutants including carcinogens emitted during the dryer cycle. The base node 3 is placed inside the building and receives real-time data transmission packages from the sensor node 1. The sensor node 1 sends the real-time data transmission packages of hazardous air pollutants including carcinogens emitted in real-time to the base node 3. The base node 3 correlates the hazardous air pollutants including carcinogens released in the dryer vent 6 during the clothes dryer cycle to the laundry detergent input 10 provided by the homeowner. The base node 3 determines when hazardous gases exceed acceptable limits and sends a real-time alert to the homeowner through the app 11. The base node 3 makes data and alerts available to the homeowner through the app 11.

Figure 2:
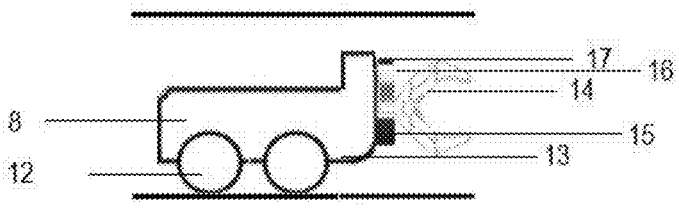
FIG. 2 is a perspective view of the autonomous bi-directional lint-removing robotic device traversing in the dryer vent as an embodiment of the invention.

As seen in FIG. 2, the invention is designed with very lightweight materials for the robotic device 8. The robotic device 8 is autonomous and is capable of moving bidirectionally and stopping at a pre-configured distance from an obstacle when the ultrasonic sensor 15 detects lint, and makes a buzzing sound. The robotic arm 14 will then close to pick up the lint. The robotic device 8 will then traverse back to the robotic device housing 4 to drop the lint in the lint basket 9. A light 17 is mounted on the robotic device 8. The robotic arm 14 size needs to be such that it can operate in the small diameter of the dryer vent 6, in addition to being very lightweight. Additionally, the robotic arm 14 has foam around the tips of robotic arm 14 to ensure it does not scrape the inner surface of the dryer vent 6, and to have a better grip on the lint. The robotic arm 14 provides predictable parallel motion and can grasp lint.

Figure 3:
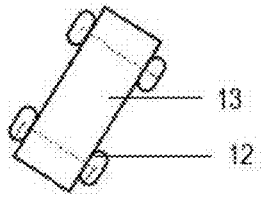
FIG. 3 is a perspective view of the chassis of the robotic device mounted with wheels.

FIG. 3 represents the base of the chassis 13, which is mounted by four wheels 12.

Figure 4:
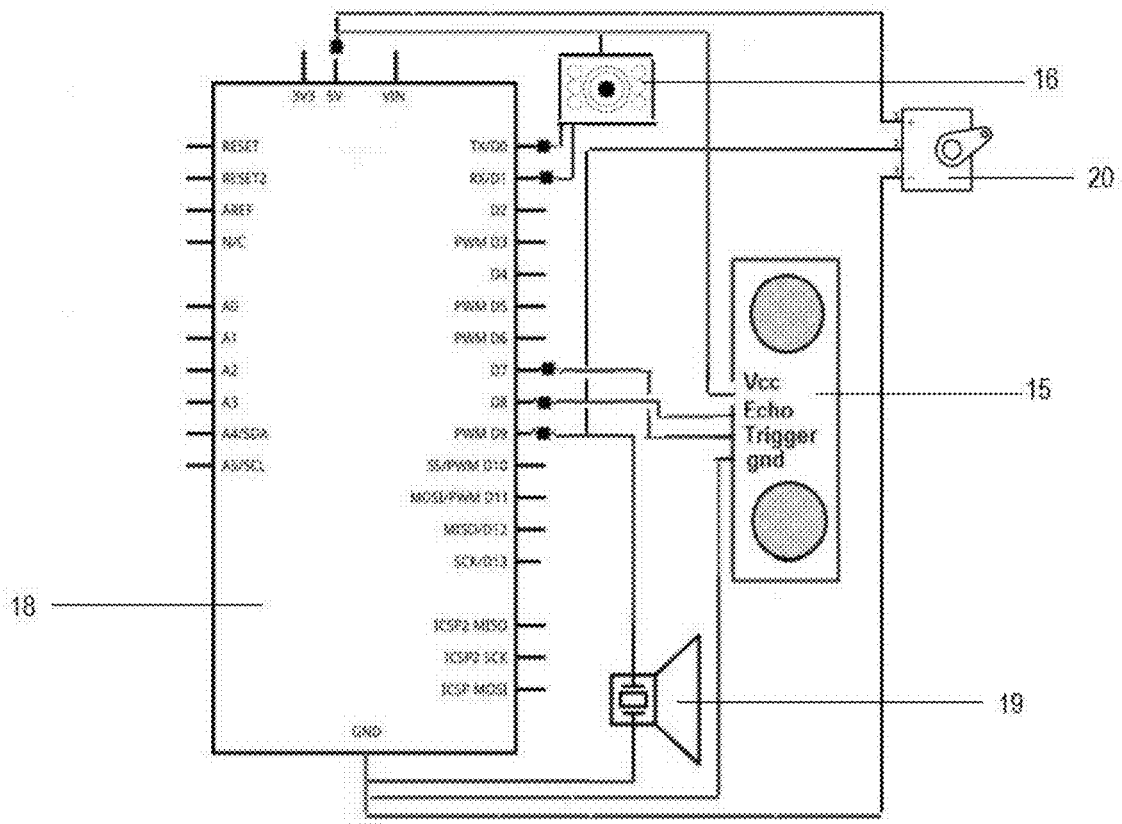
FIG. 4 is the perspective view of the microcontroller for the robotic device attached to the servo motor, camera, buzzer, and ultrasonic sensor.

FIG. 4 shows a microcontroller 18 used by the robotic device 8 which is powered by a 9V power supply module with a step-down function. The microcontroller 18 is connected to a camera 16 that can send images or live video to the app 11. An ultrasonic sensor 15 is mounted to detect lint. As the robotic device 8 moves, the transmitter on the ultrasonic sensor 15 continuously emits ultrasonic pulses and the receiver listens for the reflected waves to bounce back from lint. The ultrasonic sensor 15 is configured to stop at a preconfigured distance on detection of lint. The piezoelectric buzzer 19 will buzz when lint has been detected. The robotic arm 14 is controlled by a servo motor 20.

The described embodiment is illustrative only and is not restrictive to the use described here and the scope of the invention is therefore indicated by the claims rather than by the description above.

What is claimed is:

1. A device for a dryer vent comprising:

a sensor node having a plurality of sensors placed inside a sensor node housing, said sensor node housing placed at a exit of said dryer vent;

a base node placed inside a building, said base node receives a data transmission package from said sensor node;

a robotic device placed inside a robotic device housing, said robotic device housing placed at said exit of said dryer vent, said robotic device is capable of receiving said data transmission package from said base node and said robotic device is capable of traversal inside said dryer vent of 3¾ inch diameter to clean said dryer vent;

a lint basket placed inside said robotic device housing, said lint basket is used by said robotic device to store a lint removed from said dryer vent during a cleaning cycle; and a latch placed inside said robotic device housing, said latch receives said data transmission package from said base node to allow said robotic device to enter or exit said robotic device housing during said cleaning cycle.

2. The device of claim 1, wherein said sensor node using said plurality of sensors detects air properties including a hazardous air pollutants and carcinogens emitted in said dryer vent during a clothes dryer cycle, and said sensor node sends said data transmission package to said base node.

3. The device of claim 1, wherein said base node on a determination of blockage in said dryer vent using said plurality of sensors of said sensor node, using said data transmission package received from said sensor node, sends said data transmission package to open said latch of said robotic device housing to allow said robotic device to enter said dryer vent for said cleaning cycle, and upon completion of said cleaning cycle said robotic device returns to said robotic device housing and sends said data transmission package to said base node, said base node sends said data transmission package to close said latch of said robotic device housing.

4. The device of claim 1, wherein said base node on a determination of blockage in said dryer vent using said plurality of sensors of said sensor node, using said data transmission package received from said sensor node, sends said data transmission package to activate said robotic device to traverse out of said robotic device housing to start said cleaning cycle.

5. The device of claim 1, wherein said robotic device when activated by said base node to start said cleaning cycle and said robotic device detects and removes said lint from said dryer vent and carries said lint to said lint basket filling said lint basket with said lint collected during said cleaning cycle, said robotic device repeatedly cleans till said dryer vent is clean and returns to said robotic device housing, wherein said lint basket when full sends said data transmission package to said base node to send a alert to a homeowner to clean said lint basket.

6. The device of claim 1, wherein said base node on a determination of blockage in said dryer vent, using said data transmission package received from said sensor node using said plurality of sensors, sends said data transmission package to open said latch of said robotic device housing and activate said robotic device to traverse out of said robotic device housing, wherein said latch, once open, allows said robotic device to enter said dryer vent for said cleaning cycle, said robotic device detects and removes said lint from said dryer vent and carries said lint to said lint basket, filling said lint basket with said lint collected during said cleaning cycle, said robotic device repeatedly cleans till said dryer vent is clean and returns to said robotic device housing and upon completion of said cleaning cycle sends said data transmission package to said base node, said base node sends said data transmission package to close said latch of said robotic device housing, wherein said lint basket when full sends said data transmission package to said base node to send a alert to said a homeowner to clean said lint basket.

* * * * *